US011026305B1

(12) United States Patent
Zarcone et al.

(10) Patent No.: US 11,026,305 B1
(45) Date of Patent: Jun. 1, 2021

(54) DIMMING CIRCUIT WITH REFERENCE CONTROL

(71) Applicant: APOGEE LIGHTING HOLDINGS, LLC, Deer Park, NY (US)

(72) Inventors: Frank Zarcone, Smithtown, NY (US); James D. Chermak, East Northport, NY (US); Fred Katz, Hauppauge, NY (US)

(73) Assignee: APOGEE LIGHTING HOLDINGS, LLC, Deer Park, NY (US)

( * ) Notice: Subject to any disclaimer, the term of this patent is extended or adjusted under 35 U.S.C. 154(b) by 0 days.

(21) Appl. No.: 16/861,282

(22) Filed: Apr. 29, 2020

Related U.S. Application Data

(63) Continuation-in-part of application No. 16/677,962, filed on Nov. 8, 2019.

(51) Int. Cl.
*H05B 45/10* (2020.01)
*H05B 45/35* (2020.01)
*H05B 45/46* (2020.01)

(52) U.S. Cl.
CPC ..... *H05B 45/10* (2020.01); *H05B 45/35* (2020.01); *H05B 45/46* (2020.01)

(58) Field of Classification Search
None
See application file for complete search history.

(56) References Cited

U.S. PATENT DOCUMENTS 5,391,947 A 2/1995 Groves, Jr. et al.
6,897,709 B2 5/2005 Henry
7,196,483 B2 3/2007 Wey et al.
8,174,212 B2 5/2012 Tziony et al.
8,384,311 B2 2/2013 Gray et al.
(Continued)

FOREIGN PATENT DOCUMENTS

EP 1 782 660 B1 10/2011
JP 2015-506080 A 2/2015
(Continued)

OTHER PUBLICATIONS

"Multi-String LED Current Balancer for Use with Constant-Current Power Supplies" Texas Instruments (Jun. 2011, Revised Nov. 2013) pp. 1-23, LM3466.
(Continued)

*Primary Examiner* — Crystal L Hammond
(74) *Attorney, Agent, or Firm* — Tutunjian & Bitetto, P.C.

(57) ABSTRACT

A balance circuit includes a reference circuit configured to generate current through strings of light emitting diodes (LEDs). The reference circuit includes a first string of LEDs in series coupled to a collector node of a first transistor. A base drive current resistor is connected between the collector node and a base node of the first transistor. A base emitter resistor is connected between the base node and an emitter of the first transistor such that a reference voltage is generated on the base node during operation. Another stage receives the reference voltage to generate a tracking current through a second transistor and a second string of LEDs connected to a base of the second transistor, wherein a current through the first string of LEDs is uniformly tracked by the tracking current through the second string of LEDs.

18 Claims, 7 Drawing Sheets

(56) References Cited

U.S. PATENT DOCUMENTS

| | | | | |
|---|---|---|---|---|
| 8,390,262 | B2 * | 3/2013 | Chang | G09G 3/3413 323/282 |
| 8,669,721 | B2 | 3/2014 | Watanabe et al. | |
| 9,763,298 | B2 | 9/2017 | Weeks, Jr. et al. | |
| 2008/0203936 | A1 | 8/2008 | Mariyama et al. | |
| 2010/0102735 | A1 | 4/2010 | Chang et al. | |
| 2010/0315014 | A1 | 12/2010 | Chang et al. | |
| 2011/0148314 | A1 * | 6/2011 | Lin | H05B 45/46 315/192 |
| 2012/0049741 | A1 * | 3/2012 | Ye | H05B 45/37 315/122 |

FOREIGN PATENT DOCUMENTS

| | | | |
|---|---|---|---|
| KR | 10-1701729 | B1 | 1/2017 |
| TW | I384898 | B | 1/2010 |
| TW | I420960 | B | 12/2013 |
| WO | 2016/154169 | A1 | 9/2016 |

OTHER PUBLICATIONS

"4-Channel LED Current Balance Controller" Fairchild Semiconductor (May 2011) pp. 1-21, FAN7346.

* cited by examiner

DIMMING CIRCUIT WITH REFERENCE CONTROL

BACKGROUND

The present invention generally relates to dimming circuits, and more particularly to circuits for uniformly dimming multiple stages concurrently in accordance with a reference voltage.

Multiple strings of light emitting diodes (LEDs) are difficult to balance in terms of power. In multiple LED series strings, voltage binning of the LEDs may be employed so the voltage of each string is the same. Even with tight binning, this can still result in large voltage differences in the strings due to the sum of individual LED voltage variations.

SUMMARY

In accordance with an embodiment of the present invention, a balance circuit includes a reference stage having an output node on which a reference voltage is generated to control current through a first component string and a first resistor connected to the first component string. A stage receives the reference voltage to generate a tracking current through a second component string and a second resistor connected to the second component string. A current through the first component string is uniformly tracked by the tracking current through the second component string.

Another balance circuit includes a reference stage having an output node on which a reference voltage is generated. The reference stage includes a controllable current source, a first component string coupled to the output node and a first resistor connected to the first component string at the output node. At least one stage receives the reference voltage. The at least one stage includes a second component string, a field effect transistor having a drain coupled to the second component string, an operational amplifier which receives the reference voltage at one or its inputs and has an output coupled to a gate of the field effect transistor and a second resistor connected to a source of the field effect transistor. A current through the first component string is uniformly tracked through the second component string.

Another balance circuit includes a node on which a reference voltage is generated to control current through a first component string and a first resistor connected to the first component string; and at least one stage which receives the reference voltage to generate a tracking current through a second component string and a second resistor connected to the second component string, wherein a current through the first component string is uniformly tracked by the tracking current through the second component string.

Yet another balance circuit includes a controllable current source and a stage having a node on which a reference voltage is generated. The stage includes a first component string coupled to the node; a first resistor connected to the first component string at the node; and at least one stage which receives the reference voltage. The at least one stage includes a second component string; a field effect transistor having a drain coupled to the second component string; and an operational amplifier which receives the reference voltage at one of its inputs and has an output coupled to a gate of the field effect transistor. A second resistor is connected to a source of the field effect transistor, wherein a current through the first component string is uniformly tracked through the second component string.

A method for uniformly dimming and brightening light emitting diode strings includes providing a balance circuit including a node on which a reference voltage is generated to control current through a first component string and a first resistor connected to the first component string, and at least one stage which receives the reference voltage to generate a tracking current through a second component string and a second resistor connected to the second component string, wherein a current through the first component string is uniformly tracked by the tracking current through the second component string; and adjusting a dimmer switch to control current through the first component string to uniformly dim or brighten light emitting diode strings in additional stages.

Another method for uniformly dimming and brightening light emitting diode strings includes providing a balance circuit including a reference stage having an output node on which a reference voltage is generated to control current through a first component string and a first resistor connected to the first component string; and additional stages which receive the reference voltage to generate a tracking current through second component strings in each of the additional stages and a second resistor connected to the second component strings in each of the additional stages, wherein a current through the first component string is uniformly tracked by the tracking current through the second component string. A dimmer switch is adjusted to control current in the reference stage to uniformly dim or brighten light emitting diode strings in the additional stages.

Another balance circuit includes a reference circuit configured to generate current through strings of light emitting diodes (LEDs). The reference circuit includes a first string of LEDs in series coupled to a collector node of a first transistor; a base drive current resistor connected between the collector node and a base node of the first transistor; and a base emitter resistor connected between the base node and an emitter of the first transistor such that a reference voltage is generated on the base node during operation. A stage receives the reference voltage to generate a tracking current through a second transistor and a second string of LEDs connected to a base of the second transistor, wherein a current through the first string of LEDs is uniformly tracked by the tracking current through the second string of LEDs.

Another balance circuit includes a controllable current source. A stage having a node on which a reference voltage is generated. The stage includes a first string of light emitting diodes (LEDs) in series coupled to a collector node of a first transistor; a base drive current resistor connected between the collector node and a base node of the first transistor; a base emitter resistor connected between the base node and an emitter of the first transistor such that a reference voltage is generated on the base node during operation. Another stage receives the reference voltage to generate a tracking current through a second transistor and a second string of LEDs connected to a base of the second transistor, wherein a current through the first string of LEDs is uniformly tracked by the tracking current through the second string of LEDs.

These and other features and advantages will become apparent from the following detailed description of illustrative embodiments thereof, which is to be read in connection with the accompanying drawings.

BRIEF DESCRIPTION OF THE DRAWINGS

The following description will provide details of preferred embodiments with reference to the following figures wherein.

DETAILED DESCRIPTION

Figure 1:
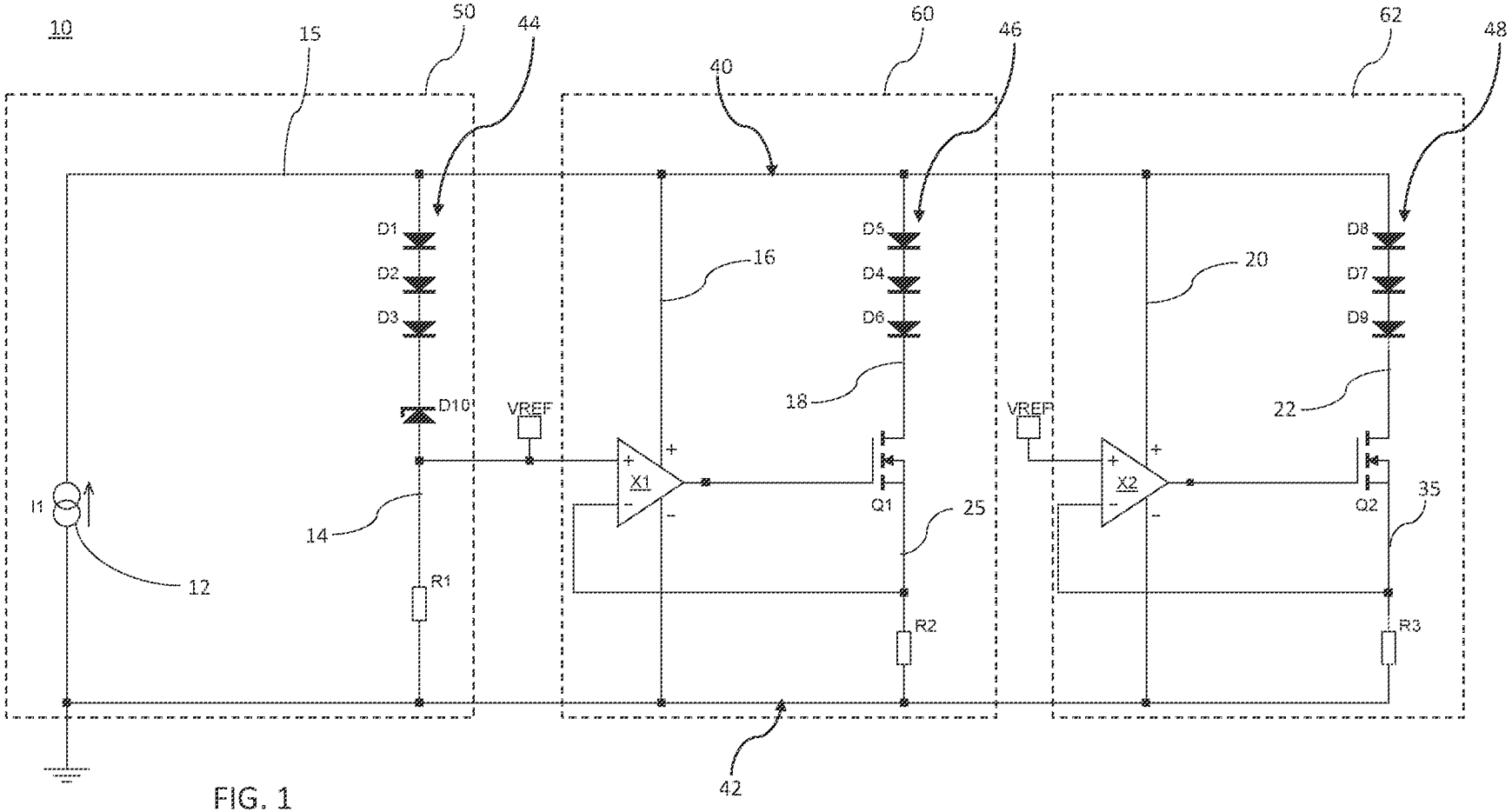
FIG. 1 is a schematic diagram showing a balance circuit for uniformly dimming and brightening light emitting diode strings in accordance with an embodiment of the present invention.

In accordance with embodiments of the present invention, balance circuits and methods for employing these circuits are provided. The balance circuits include components connected across nodes or rails. A plurality of strings of components can be controlled uniformly across multiple strings in accordance with a reference voltage generated in a first string. The first string can be a reference circuit and may or may not be part of a light generating device. The nodes are employed to load strings, which can include components such as diodes and, in particular, light emitting diodes (LEDs).

In one embodiment, a balance circuit is employed to balance a current of all the strings between nodes by monitoring the current in a first string to create a reference voltage to control the current in the other strings. Resistors in each string can be employed to set a ratio of current in the strings. The input current in the first string can vary but the ratio of current in the strings will remain the same. Since the currents in the strings track one another, all the strings can be reliably controlled. In an embodiment where the strings include LEDs, the LEDs can be dimmed or brightened evenly, e.g., balanced.

In another embodiment, a balance circuit is employed to balance a current of all the strings between nodes by monitoring the current in a one string to create a reference voltage to control the current in the other strings. Resistors in each string can be employed to set a ratio of current in the strings, and the generated reference voltage for one string is used for controlling voltage in another string. The stages have the reference voltages cross connected so that the reference voltage across all stages is equalized. The cross connection is circularly applied so that a reference voltage generated in one stage is used by another stage (e.g., next to that stage) and the reference voltage generated by the last stage can be coupled back to the first stage. Other cross connection arrangements are also contemplated. The input current can vary but the ratio of current in the strings will remain the same. Since the currents in the strings track one another, all the strings can be reliably controlled.

Exemplary applications/uses to which the present invention can be applied include, but are not limited to, LEDs. In addition, the present embodiments will be described in terms of a circuit having three strings. This is not limiting as the circuit can include two or more strings. The strings described will also be illustratively described with three LEDs; however, any number of LEDs or other components can be employed.

It is to be understood that the present embodiments will be described in terms of a given illustrative architecture; however, other architectures, structures, components, process features and steps may be varied within the scope of the present invention.

It will also be understood that when an element is referred to as being "on" or "over" another element, it can be directly on the other element or intervening elements may also be present. In contrast, when an element is referred to as being "directly on" or "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

The present embodiments may include a design for an integrated circuit chip, which may be created in a graphical computer programming language, and stored in a computer storage medium (such as a disk, tape, physical hard drive, or virtual hard drive such as in a storage access network). Methods as described herein may be used in the fabrication of integrated circuit chips. The resulting integrated circuit chips can be distributed by the fabricator in raw wafer form (that is, as a single wafer that has multiple unpackaged chips), as a bare die, or in a packaged form. In the latter case the chip is mounted in a single chip package (such as a plastic carrier, with leads that are affixed to a motherboard or other higher level carrier) or in a multichip package (such as a ceramic carrier that has either or both surface interconnections or buried interconnections).

Reference in the specification to "one embodiment" or "an embodiment" of the present principles, as well as other variations thereof, means that a particular feature, structure, characteristic, and so forth described in connection with the embodiment is included in at least one embodiment of the present principles. Thus, the appearances of the phrase "in one embodiment" or "in an embodiment", as well any other variations, appearing in various places throughout the specification are not necessarily all referring to the same embodiment.

It is to be appreciated that the use of any of the following "/", "and/or", and "at least one of", for example, in the cases of "A/B", "A and/or B" and "at least one of A and B", is intended to encompass the selection of the first listed option (A) only, or the selection of the second listed option (B) only, or the selection of both options (A and B). As a further example, in the cases of "A, B, and/or C" and "at least one of A, B, and C", such phrasing is intended to encompass the selection of the first listed option (A) only, or the selection of the second listed option (B) only, or the selection of the third listed option (C) only, or the selection of the first and the second listed options (A and B) only, or the selection of the first and third listed options (A and C) only, or the selection of the second and third listed options (B and C) only, or the selection of all three options (A and B and C). This may be extended, as readily apparent by one of ordinary skill in this and related arts, for as many items listed.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Spatially relative terms, such as "beneath," "below," "lower," "above," "upper," and the like, may be used herein for ease of description to describe one element's feature's relationship to another element(s) or feature(s) as illustrated in the FIGS. It will be understood that the spatially relative terms are intended to encompass different orientations of the device in use or operation in addition to the orientation depicted in the FIGS. For example, if the device in the FIGS. is turned over, elements described as "below" or "beneath" other elements or feature would then be oriented "above" the other elements or features. Thus, the term "below" can encompass both an orientation of above and below. The device may be otherwise oriented (rotated 90 degrees or at other orientations), the spatially relative descriptors used herein may be interpreted accordingly. In addition, it will also be understood that when a layer is referred to as being "between" layers, it can be the only layer between the two layers, or one or more intervening layers may also be present. It will be understood that, although the terms first, second, etc. may be used herein to describe various elements, these elements should not be limited by these terms. These terms are only used to distinguish one element from another element. Thus, a first element discussed below could be termed a second element without departing from the scope of the present concept.

Referring now to the drawings in which like numerals represent the same or similar elements and initially to FIG. 1, a schematic diagram shows a balancing circuit 10 having a reference circuit 50 for driving a number of component strings 46, 48. The circuit 10 can include a hardwired circuit, a printed wiring board, a semiconductor chip or chips or another other form of circuit implemented in either hardware or software. In useful embodiments, the strings 44, 46, 48 can be part of an LED lighting strip. In other embodiments, the reference circuit 50 can be a separate circuit stored in a controller or the like and be separated from the other strings 46, 48, etc.

The reference circuit 50 outputs a reference voltage (VREF) that can be employed to control dimming potential in the strings 46, 48, etc. The reference circuit 50 can include a number of different components, other than those shown in FIG. 1. However, FIG. 1, which describes an illustrative circuit, includes a current source 12. The current source 12 can be any current source that is compatible with the type of components in the strings. For example, the amount of current in one embodiment would be compatible with LEDs D1, D2, D3 and D10 in the string 44.

In one useful embodiment, reference circuit 50 includes a loop 15 supplied current by the current source 12. The loop 15 includes node 40 and intermediary node 14 across which a string of components, e.g., LEDs D1, D2, D3 and D10 are connected in series. The LEDs D1, D2, D3 will be collectively referred to as string 44. LED D10 is a signal diode configured to provide a higher voltage than the other strings to be driven (e.g., strings 46, 48, etc.). LED D10 provides an additional voltage drop between nodes 40 and 14. The reference circuit 50 outputs the node voltage at node 15 as a reference voltage VREF. The loop current I1 through the string 44, LED D10 is set using a resistor R1 (e.g., I1=VREF/R1).

In one embodiment, the current source 12 is adjustable to provide dimming control. Dimming control refers to the ability to increase or decrease lighting brightness or energy. In one embodiment, the current source 12 includes a slider or other dimming mechanism. Node 42 can include ground, although other potentials are contemplated.

The reference voltage VREF is input to a next stage 60. The stage 60 includes an operational amplifier X1. Operational amplifier X1 receives the reference voltage VREF at its non-inverting input. Operational amplifier X1 is powered by node 40 and is grounded at node 42. An inverting input of the operational amplifier X1 is connected to a node 25. In one embodiment, operational amplifier X1 includes a low power amplifier, e.g., powered directly from the LED power, or if higher voltage is needed the operational amplifier X1 can be powered using a resistor divider arrangement to provide a higher voltage. An output of the operational amplifier X1 powers a gate of a metal oxide semiconductor field effect transistor (MOSFET) Q1. The MOSFET Q1 can include an N channel MOSFET. The MOSFET Q1 includes a drain connected to the diode string 46 and a source connected to a resistor R2 and an inverting input of the operational amplifier X1.

Here, the diode string 46 illustratively includes LEDs or diodes D5, D4, D6. Diodes D5, D4, D6 may be of the same type and properties as the diodes D1, D2 and D3, respectively, of the reference stage 50; however, the voltage drop across the string 46 is less than for string 44.

For example, the voltage drop across the string 44 with diode D10 can include, e.g., 21 volts, while the voltage drop across string 46 (diodes (D5, D4, D6) could be 20 volts. A suitable MOSFET Q1 can include, e.g., a 2N6782 MOSFET, although other suitable device can be employed. Resistor R2 sets current of the diode string 46 (e.g., string current=VREF/R2).

The reference voltage VREF is also input to a next stage 62 and any additional stages. The stage 62 includes an operational amplifier X2. Operational amplifier X2 receives the reference voltage VREF at its non-inverting input. Operational amplifier X2 is powered by node 40 and is grounded at node 42. An inverting input of the operational amplifier X2 is connected to a node 35. In one embodiment, operational amplifier X2 includes a low power amplifier, e.g., powered directly from the LED power, or if higher voltage is needed the operational amplifier X2 can be powered using a resistor divider arrangement to provide a higher LED voltage. An output of the operational amplifier X2 powers a gate of a metal oxide semiconductor field effect transistor (MOSFET) Q2. The MOSFET Q2 can include an N channel MOSFET. The MOSFET Q2 includes a drain connected to the diode string 48 and a source connected to a resistor R3 and an inverting input of the operational amplifier X2.

Here, the diode string 48 illustratively includes LEDs or diodes D8, D7, D9. Diodes D8, D7, D9 may be of the same type and properties as the diodes D1, D2 and D3, respectively, of the reference stage 50; however, the voltage drop across the string 48 is less than for string 44. For example, the voltage drop across the string 44 with diode D10 can include, e.g., 22 volts, while the voltage drop across string 46 (diodes (D5, D4, D6) could be 21 volts and across string 48 (diodes (D8, D7, D9) could be 20 volts. A suitable MOSFET Q2 can include, e.g., a 2N6782 MOSFET, although other suitable devices can be employed. Resistor R3 sets current of the diode string 48 (e.g., string current=VREF/R3).

The balance circuit 10 generates the reference voltage VREF used to balance the current of the LED string 44 in stage 60 as well as additional stages, e.g., stage 62, etc. By monitoring the current in string 44, the reference voltage VREF also controls the current in the other strings. Resistors R1, R2 and R3 set the ratio of current in the strings. If the resistance is the same (e.g., 1 Ohm), the current will be the same since the voltage across the resistors R1, R2 and R3 will be VREF. Note the inverting and non-inverting inputs to operational amplifier X1 (and X2) are equal to VREF. The balance circuit 10 provides an input current that can vary but the ratio of current in the strings will remain the same. Since the current in the strings track one another, all the LEDs in all the strings can be dimmed or brightened evenly. By controlling the tolerance of resistors R1, R2 and R3, the LED current through each string (44, 46, 48, etc.) can easily be matched to less than 1% through the LED strings.

In circuit 10, D10 can include a Zener diode to add voltage drop through D1, D2 and D3. This gives the control FETs Q1 and Q2 a voltage across them so that the FETs Q1 and Q2 can control the voltage across resistors R2 and R3. Operational amplifiers X1 and X2 control Q1 and Q2, respectively to keep the voltage across R2 and R3 the same as VREF.

While the voltage drop of D10 is employed to provide a working voltage for Q1 and Q2, it can also increase power dissipation of FETs Q1 and Q2. The higher the voltage drop of D10, the higher the power of FETs Q1 and Q2. Since R1, R2 and R3 reduce the efficiency of the LED array, in particularly useful embodiments, the VREF voltage should be less than 1 volt when the LED array is at 100% brightness. In some embodiments, operational amplifiers X1 and X2 can be powered by a resistor divider (see e.g., circuit 124 in FIG. 2), an amplifier output drive current should be kept low by using a Darlington or FET control circuit as shown in FIGS. 1 and 2.

Figure 2:
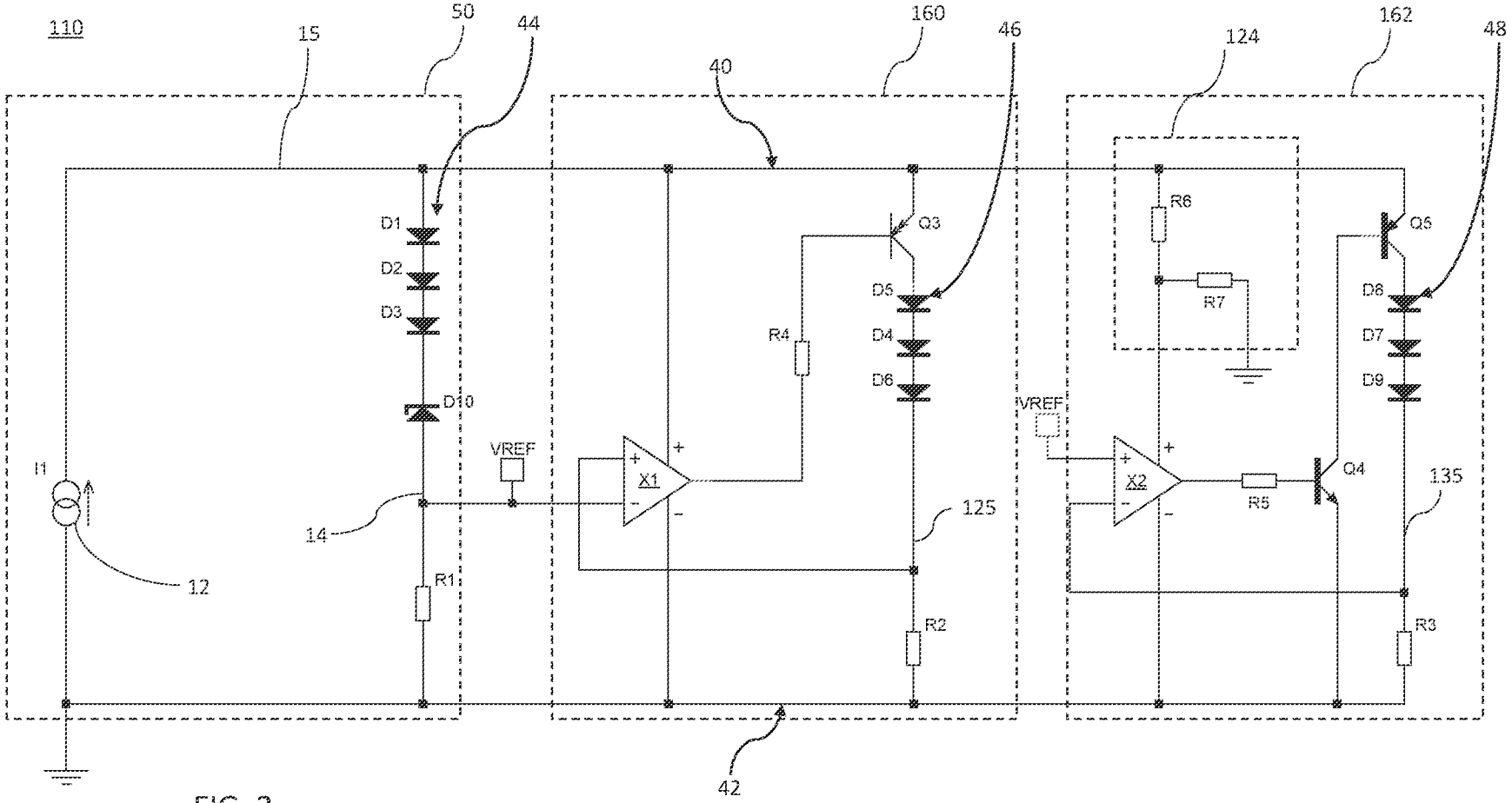
FIG. 2 is a schematic diagram showing another balance circuit for uniformly dimming and brightening light emitting diode strings in accordance with an embodiment of the present invention.

Referring now to FIG. 2, a schematic diagram shows another balancing circuit 110 having a reference circuit 50 for driving a number of component strings 46, 48. The circuit 110 can include a hardwired circuit, a printed wiring board, a semiconductor chip or chips or another other form of circuit implemented in either hardware or software. In useful embodiments, the strings 44, 46, 48 can be part of an LED lighting strip. In other embodiments, the reference circuit 50 can be a separate circuit stored in a controller or the like and be separated from the other strings 46, 48, etc.

The reference circuit 50 outputs the reference voltage (VREF) that can be employed to control dimming potential in the strings 46, 48, etc. The reference circuit 50 can include a number of different components, other than those shown. However, FIG. 2, which describes an illustrative circuit, includes a current source 12. The current source 12 can be any current source that is compatible with the type of components in the strings. For example, the amount of current in one embodiment would be compatible with LEDs D1, D2, D3 and D10 in the string 44.

In one useful embodiment, reference circuit 50 includes a loop 15 supplied current by the current source 12. The loop 15 includes node 40 and intermediary node 14 across which a string of components, e.g., LEDs D1, D2, D3 and D10 are connected in series. The LEDs D1, D2, D3 will be collectively referred to as string 44. LED D10 is a Zener diode configured to provide a higher voltage than the other strings to be driven (e.g., strings 46, 48, etc.). LED D10 provides an additional voltage drop between nodes 40 and 14. The reference circuit 50 outputs the node voltage at node 14 as a reference voltage VREF. The loop current I1 through the string 44, LED D10 is set using a resistor R1 (e.g., I1=VREF/R1).

In one embodiment, the current source 12 is adjustable to provide dimming control. Dimming control refers to the ability to increase or decrease lighting brightness or energy. In one embodiment, the current source 12 includes a slider or other dimming mechanism. Node 42 can include ground, although other potentials are contemplated.

The reference voltage VREF is input to a next stage 160. The stage 160 includes an operational amplifier X1. Operational amplifier X1 receives the reference voltage VREF at its inverting input. Operational amplifier X1 is powered by node 40 and is grounded at node 42. A non-inverting input of the operational amplifier X1 is connected to a node 125. In one embodiment, operational amplifier X1 includes a low power amplifier, e.g., powered directly from the LED power, or if higher voltage is needed the operational amplifier X1 can be powered using a resistor divider arrangement to provide a higher LED voltage (see e.g., resistors R6 and R7 in stage 162 as described herein). An output of the operational amplifier X1 powers a base of a PNP transistor/bipolar junction transistor Q3. The PNP transistor Q3 can include, e.g. a PNP Darlington transistor channel (e.g., BCV26). A voltage to a base of the PNP transistor Q3 can be adjusted using a resistor R4 (e.g., 1 MOhms). An emitter of the PNP transistor Q3 is connected to node 40, while a collector of transistor Q3 is connected to the diode string 46, which also connects to resistor R2 and the non-inverting input of the operational amplifier X1.

Here, the diode string 46 illustratively includes LEDs or diodes D5, D4, D6. Diodes D5, D4, D6 may be of the same type and properties as the diodes D1, D2 and D3, respectively, of the reference stage 50; however, the voltage drop across the string 46 is less than for string 44. For example, the voltage drop across the string 44 with diode D10 can include, e.g., 21 volts, while the voltage drop across string 46 (diodes (D5, D4, D6) could be 20 volts. A suitable transistor or junction Q3 can include, e.g., a BCV26 device, although other suitable devices can be employed. Resistor R2 sets current of the diode string 46 (e.g., string current=VREF/R2).

The reference voltage VREF is also input to a next stage 162 and any additional stages. The stage 162 includes an operational amplifier X2. Operational amplifier X2 receives the reference voltage VREF at its non-inverting input. Operational amplifier X2 is powered by node 40 through a resistor divider circuit 124 using resistor R6 and R7 to achieve an appropriate power voltage for the operational amplifier X2. In one embodiment, R6 and R7 can each have a resistance of 7 kOhms. The operational amplifier X2 is grounded at node 42. An inverting input of the operational amplifier X2 is connected to a node 135. In one embodiment, operational amplifier X2 includes a low power amplifier, e.g., powered directly from the LED power, or if higher voltage is needed the operational amplifier X2 can be powered using the resistor divider circuit 124 to provide a higher LED voltage. An output of the operational amplifier X2 is connected to a resistor R5 (to adjust the voltage (e.g., 1 MOhms)) and connects to a base of an NPN bipolar junction transistor (Rif) Q4, which is employed for low-power amplifying or switching. In one embodiment, BJT Q4 can include, e.g., a 2N2222 device, although other suitable devices can be employed. An emitter of transistor Q4 is connected to node 42 (ground) and a collector of transistor Q4 is connected to a base of PNP bipolar junction transistor (BJT) Q5. In one embodiment, BJT Q5 can include, e.g., a 2N2904 device, although other suitable devices can be employed. emitter of BJT Q5 is connected to node 40 while a collector of BJT Q5 is connected to the diode string 48.

Here, the diode string 48 illustratively includes LEDs or diodes D8, D7, D9. Diodes D8, D7, D9 may be of the same type and properties as the diodes D1, D2 and D3, respectively, of the reference stage 50; however, the voltage drop across the string 48 is less than for string 44. For example, the voltage drop across the string 44 with diode D10 can include, e.g., 22 volts, while the voltage drop across string 46 (diodes (D5, D4, D6) could be 20 volts and across string 48 (diodes (D8, D7, D9) could be 21 volts.

Resistor R3 sets current of the diode string 48 (e.g., string current=VREF/R3).

The balance circuit 110 generates the reference voltage VREF used to balance the current of the LED string 46 in stage 160 as well as additional stages, e.g., stage 162, etc. By monitoring the current in string 44, the reference voltage VREF also controls the current in the other strings. Resistors R1, R2 and R3 set the ratio of current in the strings. If the resistance is the same (e.g., 1 Ohm), the current will be the same since the voltage across the resistors R1, R2 and R3 will be VREF. Note the inverting and non-inverting inputs to operational amplifier X1 (and X2) are equal to VREF). The balance circuit 110 provides an input current that can vary but the ratio of current in the strings will remain the same. Since the current in the strings track one another, all the LEDs in all the strings can be dimmed or brightened evenly. By controlling the tolerance of resistors R1, R2 and R3, the LED current through each string (44, 46, 48, etc.) can easily be matched to less than 1%.

It should be understood that the circuits and magnitudes of components in the circuits are provided for illustrative purposes. These values can be adjusted as needed to achieve desired results. It should also be understood that other circuit components or schemes can be employed to maintain voltage drops across the string components.

Figure 3:
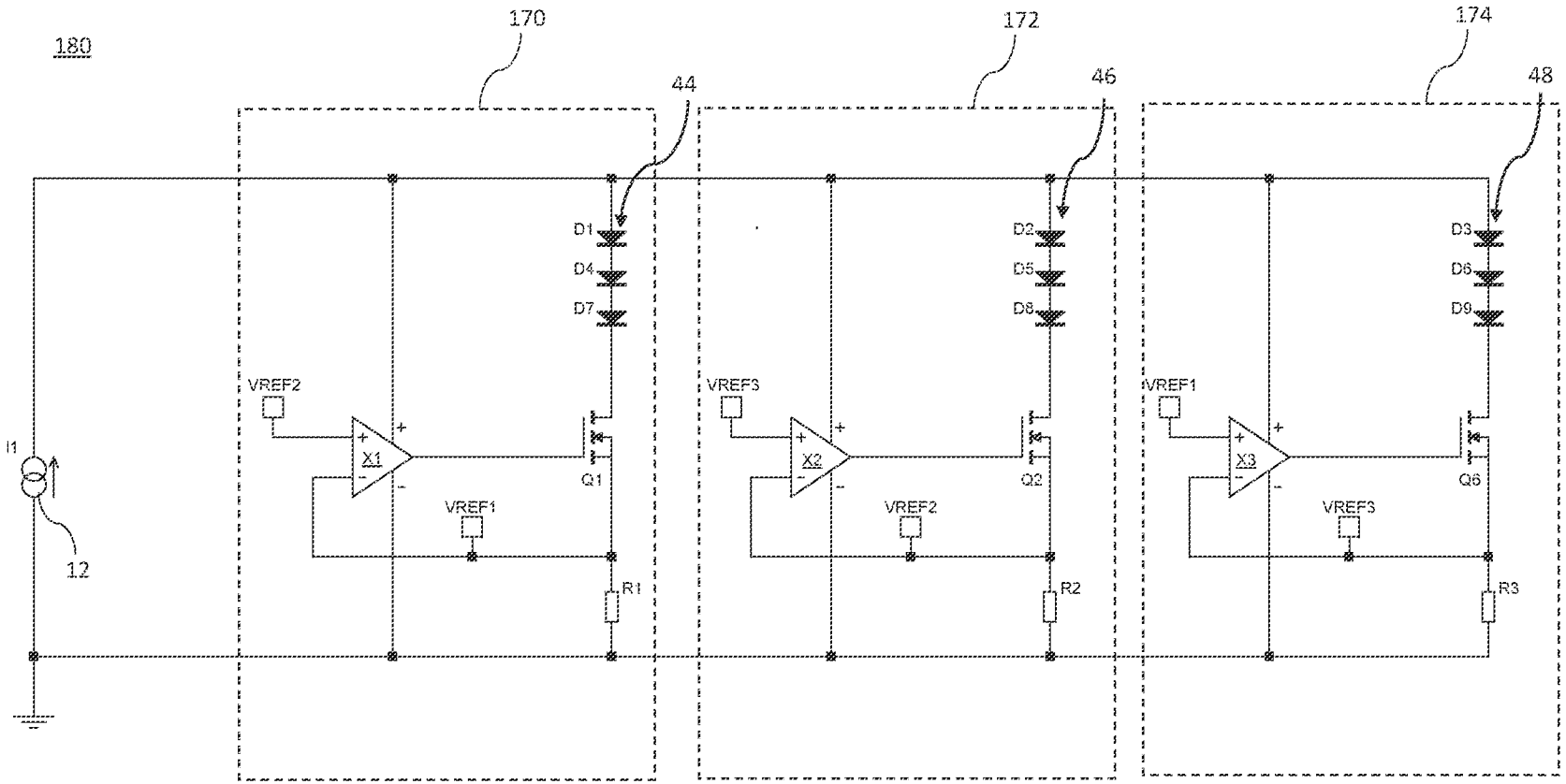
FIG. 3 is a diagram showing a lighting device or fixture that employs reference voltages from other stages to equalize the reference voltage for uniformly dimming and brightening light emitting diode strings in accordance with an embodiment of the present invention.

Referring to FIG. 3, in accordance with another embodiment, a balance circuit 180 balances current of all the LED strings by measuring the current in one string to create a reference voltage to control the current in another string. By using a measured voltage from one stage to create the reference voltage of another stage in a circular fashion, the circuit 180 automatically balances itself and makes all the reference voltages equal. Resistors R1, R2 and R3 set the ratio of current in strings 44, 46, 48. If the resistance is the same (R1, R2, R3 substantially equal, within about 5% of each other and preferably about 1%), the current will be the same. An input current I1 of a current source 12 can vary but a ratio of current in the strings 44, 46, 48 will be maintained the same. Since the current in the strings 44, 46, 48 track one another, all the LEDs (D1, D4, D7; D2, D5, D8 and D3, D6, D9) can be dimmed (or lit) evenly. By controlling the tolerance of resistors R1, R2 and R3, the LED current can easily be matched to less than 1%.

Low power operational amplifiers X1, X2, X3 have a reference voltage connected to one input and a second reference voltage connected to the other input. The operational amplifiers X1, X2, X3 can be powered directly from the LED power or a resistor divider if the voltage is high.

Resistors R1, R2, R3 for setting current ratio of LED strings (String 44 Current (for stage 170)=I1/(R1+R2+R3)*R1, String 46 Current (for stage 172)=I1/(R1+R2+R3)*R2 and String 46 Current (for stage 174)=I1/(R1+R2+R3)*R3. In one embodiment, the resistor value can be chosen to have a voltage drop of about 1 volt at maximum current. I1 is the LED current source with dimming control. D1-D9 are LEDs. Q1, Q2, Q6 are N channel MOSFETs (low "on" resistance). A suitable MOSFET Q1, Q2 and Q6 can include a 2N6782 MOSFET, although other suitable devices can be employed.

In one example, stage 170 includes VREF2 at its non-inverting input and VREF1 at its inverting input. Stage 172 includes VREF3 at its non-inverting input and VREF2 at its inverting input. Stage 174 includes VREF1 at its non-inverting input and VREF3 at its inverting input. A measured reference voltage at the inverting input from one stage is employed to create the reference voltage of another stage in a circular fashion (e.g., each stage cross connected to a next stage with the last stage being cross connected to the first stage). The reference voltages can be for adjacent circuits or can be linked in any suitable way to provide a circular powering of reference voltages between stages. In this way, the circuit 180 automatically balances itself and makes all the reference voltages equal. This can be referred to as cross connection between stages to equalize the reference voltages to control concurrent dimming (or brightening) of LEDs in the stages.

The circuits 10 (FIG. 1), 110 (FIG. 2) and 180 (FIG. 3) can be implemented on application specific integrated circuits (ASICs), provided on printed wring boards, hardwired on a substrate or configured in any other suitable manner.

Figure 4:
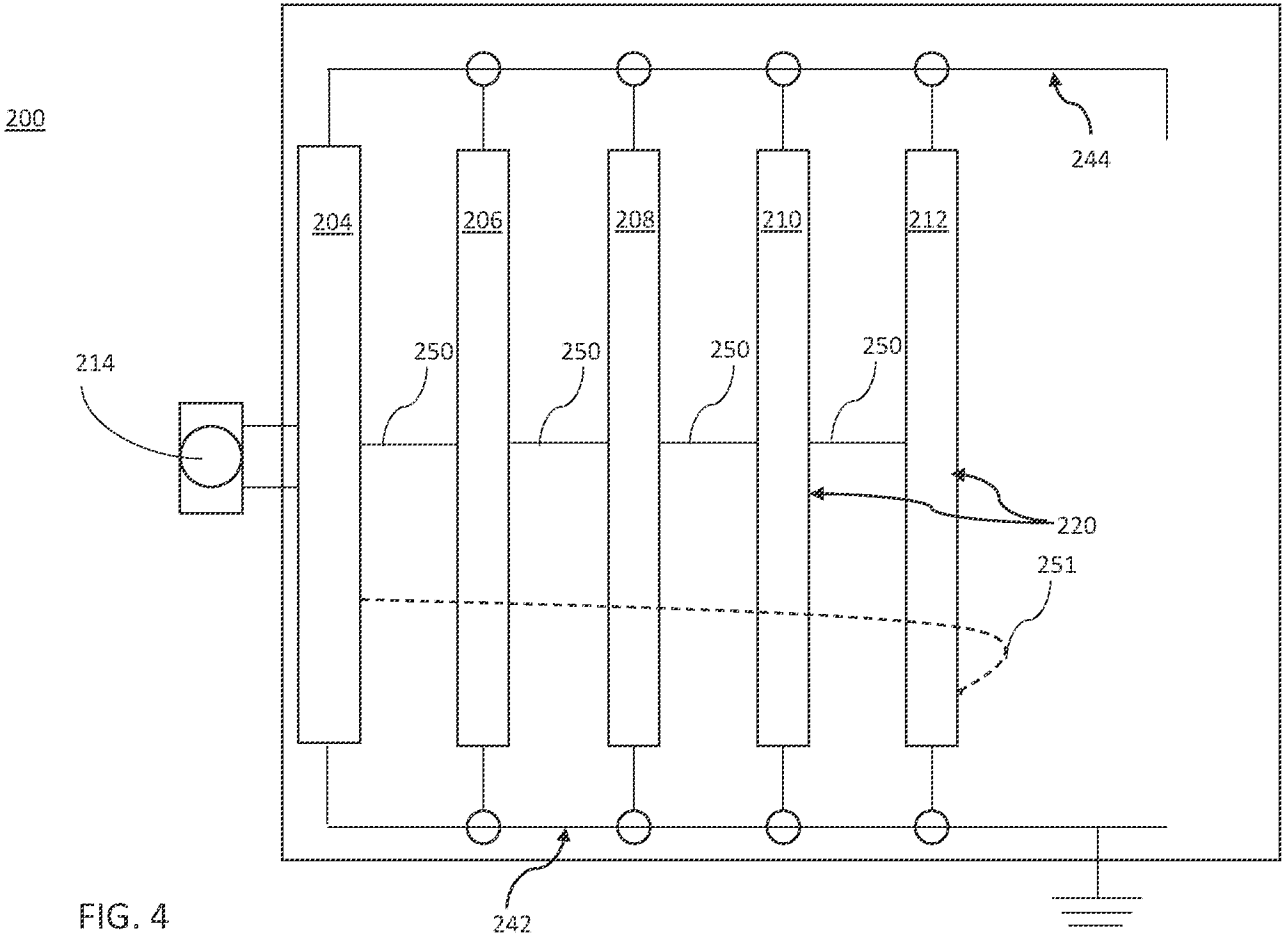
FIG. 4 is a diagram showing a lighting device or fixture that employs a balance circuit for uniformly dimming and brightening light emitting diode strings in accordance with an embodiment of the present invention.

Referring to FIG. 4, a lighting device or fixture 200 is shown in accordance with one useful embodiment. The lighting device 200 includes a plurality of LED strings arranged in stages 204, 206, 208, 210 and 212. Stages 204, 206, 208, 210 and 212 are illustratively depicted as being next to one another, but these stages can be distributed about a room on a wall, about a house or any other suitable arrangement. Stages 204, 206, 208, 210 and 212 can be modular and added or subtracted, as needed.

In a distributed arrangement, the distribution of stages 204, 206, 208, 210 and 212 can share VREF 250, which is generated using the string of components (e.g., LEDs). In one embodiment, stage 204 can include a reference stage 204. In another embodiment, the stages are cross connected and include a cross-connection link 251 to provide a circular interconnection of reference voltages between stages. Power for the strings in each stage 204, 206, 208, 210 and 212 can be supplied using house voltage (AC) or a common DC voltage. In one embodiment, AC voltage is employed at a power rail or connection 244. In this case, a rectifier and/or a transformer may be needed to convert AC to DC for each circuit or for the device 200 as a whole.

Each stage 204, 206, 208, 210 and 212 can include a string of LEDs, which are employed as a light source. The number of LEDs in each string can be selected for the desired voltage drop across the string. The reference stage 204 can include an additional LED or Zener to provide the appropriate voltage drop, as described above. The LEDs are dimmable and the dimming operation can be controlled using a dimming switch 214 or other mechanism. The dimming switch 214 function as a current source and can be controlled by adjusting the resistance or other electrical characteristics to increase or decrease the current through the reference stage 204. A same reference voltage is employed for stages 206, 208, 210, 212, etc. as generated by the reference stage 204 or by using cross-connections between stages. The voltage in each stage is not binned. Instead, current in the stages 206, 208, 210, 212 tracks the current in the reference stage 204 or reference voltages are shared to permit current to be tracked between stages. In this way, the LEDs of stages 204, 206, 208, 210, 212 are dimmed or brightened together and uniformly. The uniformity of the dimming of the stages relies on resistor tolerances, which can be controlled to a very high degree. Hence, the uniformity across all stages, which are independently powered is well controlled to less than about 1% across all stages, and, in many cases can be controlled to much less than 1% (e.g., 0.2% or more).

In one embodiment, the stages may be added or removed depending on the platform used for the device 200. In one useful embodiment, the string 206, 208, etc. is plugged in directly to a previous stage or can be plugged into the reference stage 204 directly. It should be noted that the reference stage 204 may be employed for lighting or not employed for lighting. In one embodiment, the reference stage 204 can be employed to simulate the other stages and include components other than LEDs (e.g., diodes or other electrical elements). In such an embodiment, the reference stage 204 is simply used as a reference generation circuit.

The dimming switch 214 can be employed to increase or decrease the current in the reference circuit to adjust the VREF 250 (and/or 251) and hence adjust the current in the remaining stages, etc. The dimming switch 214 can be a manual switch, such as e.g., a knob, slider, or the like. In other embodiment, the switch 214 can be controlled electrically or electronically be a controller or other mechanism.

Each stage 204, 206, 208, etc. includes the LED string or strings, operational amplifiers, MOSFETs, etc. for that stage. The stages 204, 206, 208, etc. can be encased with a protective cover 220 made of a translucent material such as, e.g., glass or plastic, to form a bulb.

Figure 5:
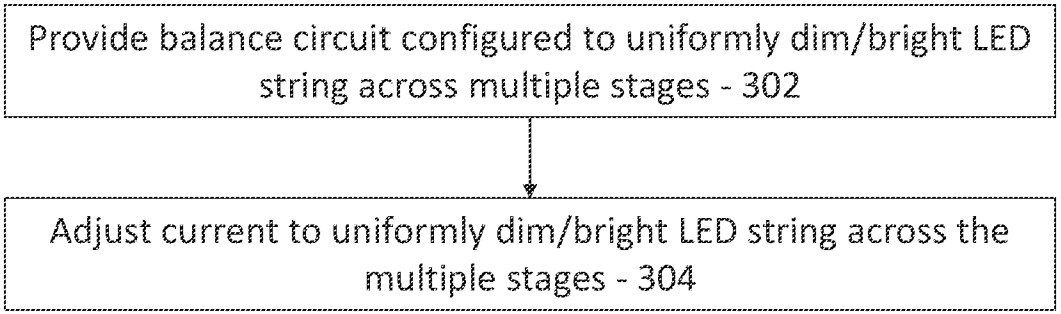
FIG. 5 is a block/flow diagram showing a method for uniformly dimming and brightening light emitting diode strings in accordance with an embodiment of the present invention.

Referring to FIG. 5, a block/flow diagram shows a method for uniformly dimming/brightening LEDs using a balance circuit in accordance with aspects of the present invention. In block 302, a balance circuit is employed that includes a node on which a reference voltage is generated to control current through a first component string and a first resistor connected to the first component string, and at least one stage which receives the reference voltage to generate a tracking current through a second component string and a second resistor connected to the second component string, wherein a current through the first component string is uniformly tracked by the tracking current through the second component string. In one embodiment, the node includes an output node on which a reference voltage is provided to control current through a first component string and a first resistor connected to the first component string. One or more additional stages receive the reference voltage to generate a tracking current through second component strings in each of the additional stages and a second resistor connected to the second component strings in each of the additional stages. A current through the first component string is uniformly tracked by the tracking current through the second component string. The balance circuit is configured to provide balance uniformly current across multiple stages (multiple LED strings) concurrently to permit uniform adjustment (e.g., dim/brightness) of the multiple LED strings across the stages.

In block 304, a dimmer switch or other control is adjusted to control current in the first component string. The current in the first component string is employed to uniformly dim or brighten light emitting diode strings in the additional stages.

Figure 6:
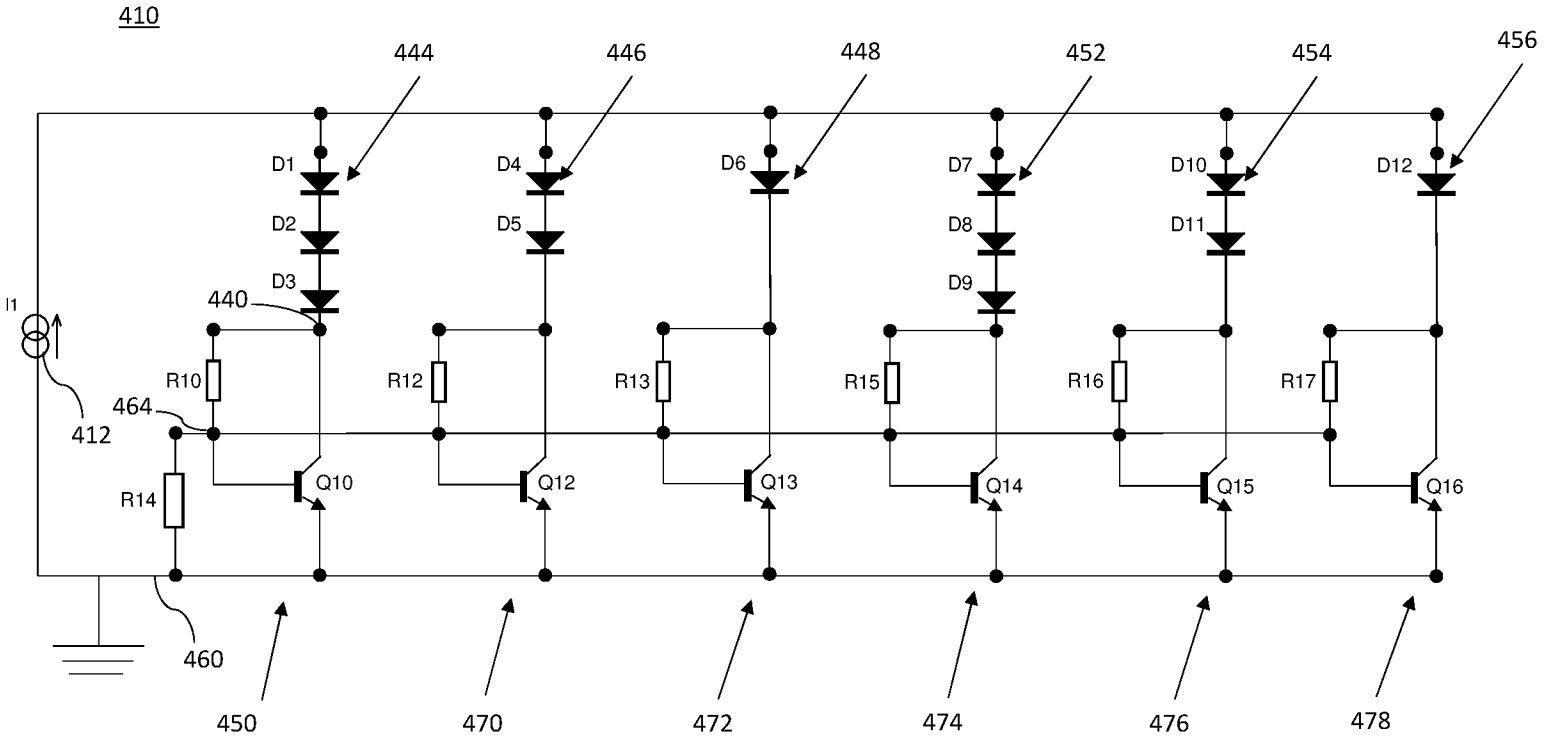
FIG. 6 is a schematic diagram showing a balance circuit for uniformly dimming and brightening light emitting diode strings in accordance with another embodiment of the present invention.

Referring to FIG. 6, a schematic diagram shows another balancing circuit 410 having a reference circuit 450 for driving a number of component strings 446, 448, 452, 454, 456. The circuit 410 can include a hardwired circuit, a printed wiring board, a semiconductor chip or chips or another other form of circuit implemented in either hardware or software. In useful embodiments, the strings 444, 446, 448, 452, 454, 456 can be part of an LED lighting strip or may be distributed over a number of boards or chips. In other embodiments, the reference circuit 450 can be a separate circuit stored in a controller or the like and be separated from the other strings 444, 446, 448, etc.

The reference circuit 450 can be employed to control dimming potential in the strings 444, 446, 448, etc. The reference circuit 450 can include a number of different components, other than those shown in FIG. 6. However, FIG. 6, which describes an illustrative circuit, includes a current source 412. The current source 412 can be any current source that is compatible with the type of components in the strings. For example, the amount of current in one embodiment would be compatible with LEDs D1-D12.

In one useful embodiment, reference circuit 450 includes a first string of diodes D1, D2, D3. A base drive current resistor R10 connects between a base collector node 440 and a reference or base node 464. Node 440 further connects with a collector of a transistor Q10. Node 464 connects between the base of the transistor Q10 and to a base emitter resistor R14. Base emitter resistor R14 connects between a base and an emitter of the transistor Q10. The transistor Q10 can include, e.g., an NPN transistor; however, polarities and connections can be reversed in other embodiments. The collector node 460 is common to the reference circuit 450 and all stages. In this illustrative embodiment, stages 470-478 share node 460. In the embodiment shown, node 460 is connected to ground.

Each stage 470-478 can include a different number of diodes which can be dimmed in unison along with diode string 444 and strings 446, 448, 452, 454, 456. For example, the diodes D1-D3 of string 444 of the reference circuit 450 can be dimmed together with the diodes D4, D5 of string 446 of stage 470, diode D6 of string 448 of stage 472, diodes D7, D8, D9 of string 452 of stage 474, diodes D10, D11 of string 454 of stage 476 and diode D12 of string 456 of stage 478. Each stage 470-478 includes a base drive current resistor R12, R13, R15, R16 and R17, respectively. Each stage 470-478 shares the base collector node 460.

The circuit 400 balances the current of all the LED strings 444, 446, 448, 452, 454 and 456 by creating a base current on transistors Q10, Q12, Q13, Q14, Q15 and Q16 that when amplified by the respective transistors Q10, Q12, Q13, Q14, Q15 and Q16 matches a total current of all the strings 444, 446, 448, 452, 454, 456. Since the base current is the same for all the transistors Q10, Q12, Q13, Q14, Q15 and Q16, collector current will be the same if the transistors Q10, Q12, Q13, Q14, Q15 and Q16 provide a same gain.

The circuit 400 permits that as an input current I1 varies the circuit 400 (provides dimming/brightening control) will keep the current in the strings 444, 446, 448, 452, 454 and 456 equal. Since the current I1 in the strings 444, 446, 448, 452, 454 and 456 remains equal, all the LEDs D1-D12 in this example will dim evenly. The circuit 400 avoids multiple LED series strings having to voltage bin the LEDs so the voltage of each string is the same. Even with tight binning this can still result in large voltage tolerance difference in the strings due to tolerance stack up of multiple LEDs. Another advantage includes the simplicity of the circuit 400. Circuit employs the transistors Q10, Q12, Q13, Q14, Q15 and Q16 to provide the gain/amplification without the use of operational amplifiers. Transistors Q10, Q12, Q13, Q14, Q15 and Q16 can be selected to have a same gain, e.g., a gain within about +/−5% of each other.

It should be understood the strings 444, 446, 448, 452, 454 and 456 can each be mounted on a separate panel or chip. In this way, the LEDs or diodes D1-D12 can be uniformly dimmed across a number of light fixtures in a same room or area. The circuit 400 can maintain string differences to well under 10 mVolts and more preferably less than about 0.5 mVolts or better. The differences in dimming and forward voltage can be held to less than about 5%, and more preferably less than about 1%. The string currents through the diodes strings can be uniformly tracked between the first string in the reference circuit and the diode strings in the stages within a tolerance of less than about 1%. The accuracy does not rely on the accumulated tolerances and voltage binning, but instead, relies on the tight control of the transistor properties, which can be accurately and more easily controlled. Transistors Q10, Q12, Q13, Q14, Q15 and Q16 can include a same design and include a base current within about 5% of the each other, and more particularly the base current between each transistor Q12, Q13, Q14, Q15 and Q16 in within 5% or better compared to transistor Q10.

Figure 7:
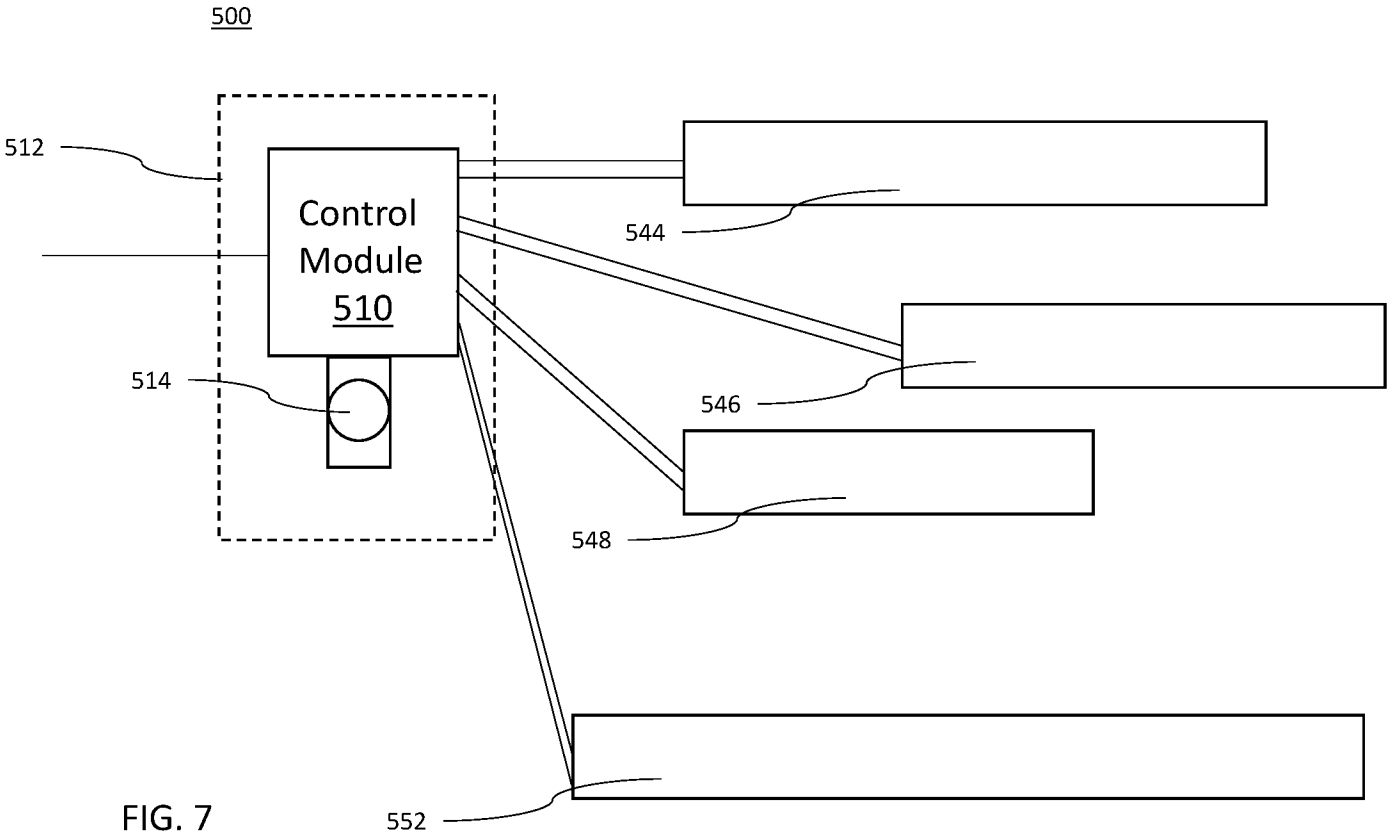
FIG. 7 is a diagram showing a lighting device or fixture that employs a balance circuit for uniformly dimming and brightening light emitting diode strings in accordance with another embodiment of the present invention.

Referring to FIG. 7, an LED circuit or LED tape 500 includes a control module 510 that further includes a circuit having a plurality of connection points for connecting lighting panels or light strings 544, 546, 548, 552, etc. The lighting panels or strings 544, 546, 548, 552 can include strings of LEDs (e.g., strings 444, 446, 448, 452, 454, etc. of FIG. 6). In one embodiment, the control module 510 includes the base drive current resistors R10, R12, R13, R15, etc. of FIG. 6, the base emitter resistor R14 of FIG. 6 and the transistors Q10, Q12, Q13, Q14, etc. of FIG. 6. In other embodiments, the panels 544, 546, 548, 552 can include respective base drive current resistors R12, R13, R15, etc. of FIG. 6 and the transistors Q12, Q13, Q14, etc. of FIG. 6.

The control module 510 can include a manual or automatic dimming control 514 to adjust current I1 to adjust the power to dim or energize the lighting panels 544, 546, 548, 552. It should be understood that the lighting panels 544, 546, 548, 552 can include any number of LEDs. In one embodiment, the panels 544, 546, 548, 552 can include tens or even hundreds of LEDs. The panels 544, 546, 548, 552 need not have the same number of LEDs, yet the panels and the LEDs disposed thereon can all be dimmed concurrently in accordance with the dimming control 514 of the control module 510.

A control assembly 512 can be provided as a chip set, printed wiring board or other device that can be wired into a plurality of panels to provide control functions and dimming capabilities. In one embodiment, the control assembly 512 can be assembled into one of the panels 544, 546, 548, 552 to function as a master panel to control the other panels. In other embodiments, the control assembly 512 can be integrated into a light switch or function as a light switch to enable power and dimming control to one or more panels. In other embodiments, the control assembly 512 can include a junction box for a display LED strip. The LED strip can be divided into segments instead of panels 544, 546, 548, 552. It should be understood that the control assembly 512 can work with a plurality or panels, or a plurality of diodes or a single panel or strip with segments.

It should also be understood that the embodiments described throughout this disclosure can be combined in whole or in part with other embodiments described in this disclosure. This includes components and systems such that different dimming circuits or components can be employed together with a same control or multiple controls. In addition, reference stages may be employed with different LED stages and circuits can be mixed together to provide uniform dimming control.

Having described preferred embodiments for balancing devices, circuits, systems and methods (which are intended to be illustrative and not limiting), it is noted that modifications and variations can be made by persons skilled in the art in light of the above teachings. It is therefore to be understood that changes may be made in the particular embodiments disclosed which are within the scope of the invention as outlined by the appended claims. Having thus described aspects of the invention, with the details and particularity required by the patent laws, what is claimed and desired protected by Letters Patent is set forth in the appended claims.

What is claimed is:

1. A balance circuit, comprising:

a reference circuit configured to generate current through strings of light emitting diodes (LEDs), the reference circuit including:

a first string of LEDs in series coupled to a collector node of a first transistor;

a base drive current resistor connected between the collector node and a base node of the first transistor;

a base emitter resistor connected between the base node and an emitter of the first transistor such that a reference voltage is generated on the base node during operation; and at least one stage which receives the reference voltage to generate a tracking current through a second transistor and a second string of LEDs connected to a base of the second transistor, wherein a current through the first string of LEDs is uniformly tracked by the tracking current through the second string of LEDs.

2. The balance circuit as recited in claim 1, wherein the current through the first string of LEDs is employed to uniformly dim or brighten light emitting diodes in the second string of LEDs.

3. The balance circuit as recited in claim 1, wherein the at least one stage includes a plurality of stages wherein the current through the first string of LEDs is employed to uniformly dim or brighten light emitting diodes in the plurality of stages.

4. The balance circuit as recited in claim 3, wherein the plurality of stages each includes a corresponding transistor and each corresponding transistor includes a same gain as the first transistor.

5. The balance circuit as recited in claim 3, wherein the plurality of stages each includes a corresponding transistor and each corresponding transistor includes a same base current as the first transistor.

6. The balance circuit as recited in claim 1, wherein the first transistor and the second transistor include a same gain.

7. The balance circuit as recited in claim 1, wherein the first transistor and the second transistor include a same base current.

8. The balance circuit as recited in claim 1, wherein the balance circuit is integrated in a light emitting diode light fixture.

9. The balance circuit as recited in claim 1, wherein the current through the first transistor is uniformly tracked through the second transistor with a tolerance of less than about 1%.

10. A balance circuit, comprising:

a controllable current source;

a stage having a node on which a reference voltage is generated, the stage including:

a first string of light emitting diodes (LEDs) in series coupled to a collector node of a first transistor;

a base drive current resistor connected between the collector node and a base node of the first transistor;

a base emitter resistor connected between the base node and an emitter of the first transistor such that a reference voltage is generated on the base node during operation; and at least one stage which receives the reference voltage to generate a tracking current through a second transistor and a second string of LEDs connected to a base of the second transistor, wherein a current through the first string of LEDs is uniformly tracked by the tracking current through the second string of LEDs.

11. The balance circuit as recited in claim 10, wherein the current through the controllable current source is employed to uniformly dim or brighten LEDs in the first string and the second string of LEDs.

12. The balance circuit as recited in claim 10, wherein the at least one stage includes a plurality of stages wherein the current through the controllable current source is employed to uniformly dim or brighten LEDs in the plurality of stages.

13. The balance circuit as recited in claim 12, wherein the plurality of stages each includes a corresponding transistor and each corresponding transistor includes a same gain as the first transistor.

14. The balance circuit as recited in claim 13, wherein the plurality of stages each includes a corresponding transistor and each corresponding transistor includes a same base current as the first transistor.

15. The balance circuit as recited in claim 10, wherein the first transistor and the second transistor include a same gain.

16. The balance circuit as recited in claim 10, wherein the first transistor and the second transistor include a same base current.

17. The balance circuit as recited in claim 10, wherein the balance circuit is integrated in a light emitting diode light fixture.

18. The balance circuit as recited in claim 10, wherein the current through the first transistor is uniformly tracked through the second transistor with a tolerance of less than about 1%.

* * * * *